US007784230B2

(12) United States Patent
Soux

(10) Patent No.: US 7,784,230 B2
(45) Date of Patent: Aug. 31, 2010

(54) SOLID WOOD BLOCK

(76) Inventor: Jacques Soux, Impasse des Arbousiers Morta, Prunelli di Fiumorbo (FR) F-20243

( * ) Notice: Subject to any disclaimer, the term of this patent is extended or adjusted under 35 U.S.C. 154(b) by 782 days.

(21) Appl. No.: 10/534,021

(22) PCT Filed: Oct. 14, 2003

(86) PCT No.: PCT/FR03/50091

§ 371 (c)(1),
(2), (4) Date: Dec. 29, 2005

(87) PCT Pub. No.: WO2004/042170

PCT Pub. Date: May 21, 2004

(65) Prior Publication Data

US 2006/0137281 A1 Jun. 29, 2006

(30) Foreign Application Priority Data

Nov. 5, 2002 (FR) ..... 02 13905

(51) Int. Cl.
*E04B 1/10* (2006.01)

(52) U.S. Cl. ..... 52/233; 52/605; 52/606

(58) Field of Classification Search ..... 52/233, 52/605, 606

See application file for complete search history.

(56) References Cited

U.S. PATENT DOCUMENTS 3,343,328 A * 9/1967 Rolle ..... 52/605
4,121,397 A * 10/1978 Marcocci et al. ..... 52/286
5,890,332 A 4/1999 Skidmore
2002/0157334 A1 * 10/2002 Smith ..... 52/233

FOREIGN PATENT DOCUMENTS

| | | |
|---|---|---|
| CA | 2234732 | 10/1999 |
| DE | 2736990 | 3/1979 |
| DE | 2739017 | 3/1979 |
| DE | 19835241 | 2/2000 |
| EP | 0149689 | 7/1985 |
| FR | 2079685 | 11/1971 |
| FR | 2139125 | 1/1973 |
| FR | 2616643 | 12/1988 |
| FR | 2004632 | 9/1999 |
| GB | 42653504 | 4/1935 |

* cited by examiner

*Primary Examiner*—Richard E Chilcot, Jr.
*Assistant Examiner*—Alp Akbasli
(74) *Attorney, Agent, or Firm*—Young & Thompson

(57) ABSTRACT

Block made of solid wood or pressboard that is used in, construction on the same principle as masonry blocks by staggered stacking. It is provided with two flange on its upper portion, two grooves on its lower portion, and its end assembly is produced by using splined tongue and groove joints. Two countersunk holes are on its upper portion and in the two ends in a symmetrical way. These pilot holes allow the passage of a screw or a metal point so as to link the block to the initial support or to the lower block. The assembly of the right-angle quoins makes it necessary to grind flanges over the portion of assembly only. These blocks are used in the field of construction of buildings. They quickly enhance the value of and store accidental products such as fallen trees to improve the value of the scraps from the wood industry.

17 Claims, 1 Drawing Sheet

1
5
7
6
2
8
12
4
9
10
11
15
screw
13
3

SOLID WOOD BLOCK

BACKGROUND OF THE INVENTION

This invention relates to a design of profiles and assemblies of a block that is made of solid wood or pressboard that is used in construction on the same principle and the same method as the traditional masonry block during the construction of a solid wall by staggered stacking.

DESCRIPTION OF THE PREFERRED EMBODIMENTS

Figures 1, 2, 3:
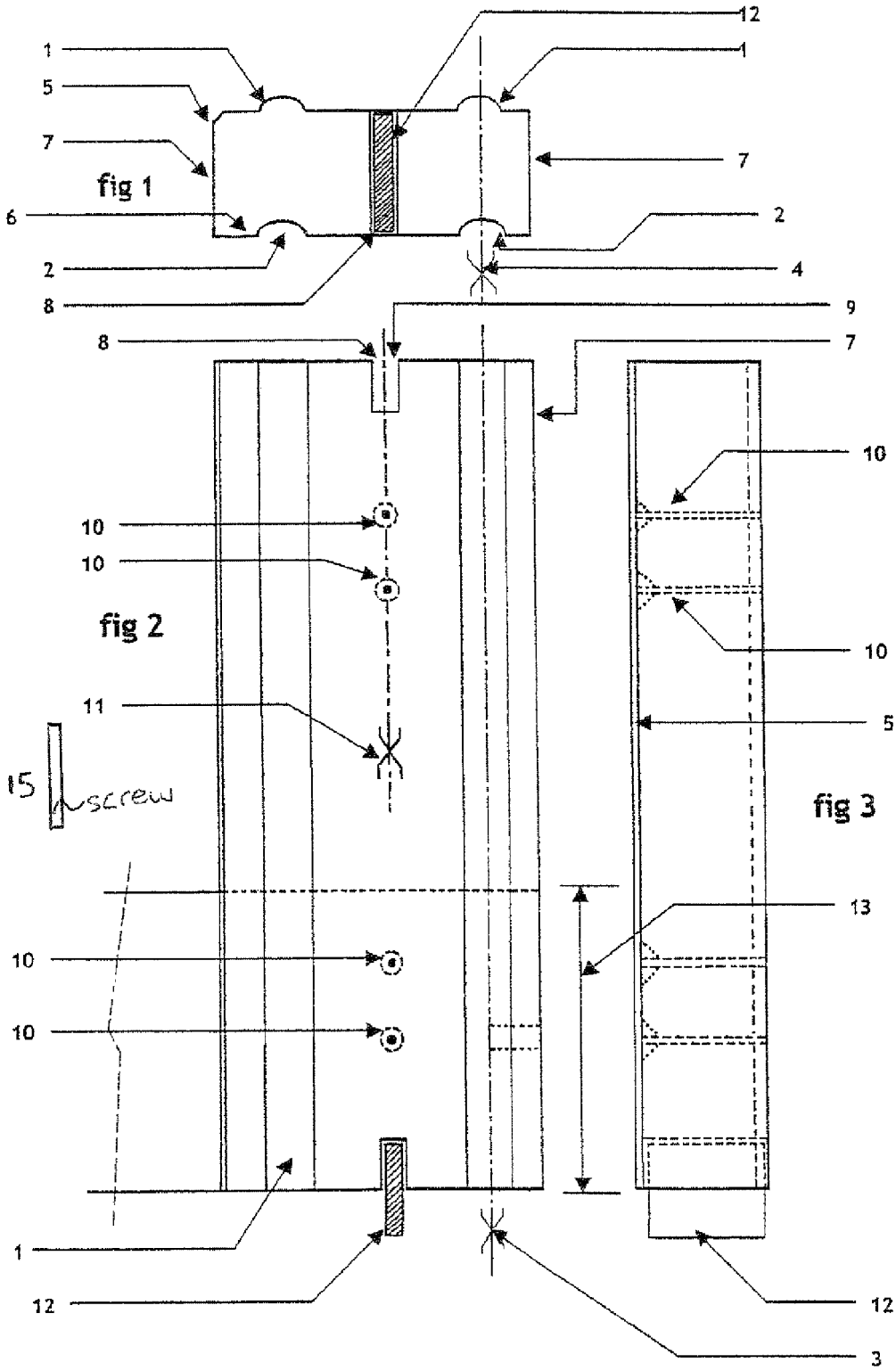
FIG. 1 is a sectional view of the invention.
FIG. 2 is an elevation view of the invention.
FIG. 3 is a side view of the invention.

The inventive block is a rectanglular parallelepipedic block of wood with variable thicknesses and heights up to 20 centimeters and all smaller dimensions and a length that does not exceed sixty centimeters and all smaller dimensions, whose ratio of the length to the width does not exceed one third.

Its assembly process is an ordinary tongue and groove joint with double flanges (1) on its upper face and double grooves (2) on its lower face. The upper face comprising an upper bearing surface located within and delimited by adjacent interior edges of the pair of flanges; and the lower face comprising a lower supported surface located within and delimited by adjacent interior edges of the pair of grooves.

A longitudinal axis (3) of the flanges on the upper face and a longitudinal axis (3) of the grooves on the lower face are facing each other two by two on same vertical axis (4).

The profile of the flanges and grooves is in a semi-circle whose cumulative length of chords or diameters per face cannot exceed one third of the width of the block, and the area of beveled edge (5) is subtracted from this width when the latter is profiled on the upper edge of the block.

The diameter or chord of the groove is ten percent larger than the diameter of the flange, and the distance between outside edge (6) of the groove and adjacent wall facing (7) cannot be less than one-tenth of the width calculated on the upper face of the block.

The assembly of the block at its two ends is symmetrical and, by using splined tongue and groove joints (8), parallel to the wall facings and perpendicular to the upper and lower faces.

According to the size of the block, several splined tongue and groove joints can be produced, whereby the scraped area that is caused by the latter should not exceed one-third of the surface area of its square section and the groove depth that should not exceed the distance between the wall facing and first line (9) of the groove.

Two countersunk holes (10) that are perpendicular to the upper face of the block cross it up to its lower face; they are located on the same axis (11) that is parallel to the flanges and between the latter.

For one of the holes, from the leveling course the distance is equal to a half-width of a block, and for the other hole it is equal to three-quarters of its length.

The group of these two holes is equal in number to the number of grooves of splined tongue and groove joints that are in the same longitudinal axis (11) and are symmetrical to the two ends of the block.

The diameter of these holes that should not exceed the side of the width of the splined tongue and groove joint and allows the passage of screws (15) or metal tips of equal diameter.

The depth of screwing or nailing of the upper block into the lower block is equal to at least one third of the thickness of the latter.

The installation of spline (12) whose length, thickness and width are less than five percent when it is positioned between two blocks placed end to end.

The grinding of the flanges is carried out only on the portion covered by assembly (13) when block walls are joined at a right angle and with conventional clamping.

The nailing or screwing of the upper block to the lower block on this assembly portion is carried out by the existing hole or holes.

REFERENCES

FIG. 1 Section
FIG. 2 Elevation
FIG. 3 Side view
1. Flange
2. Groove
3. Longitudinal axis
4. Vertical axis
5. Beveled edge
6. Outside edge
7. Wall facing
8. Tongue and groove joint
9. Line
10. Hole
11. Parallel axis
12. Spline
13. Assembly

The invention claimed is:

1. A block made of solid wood or pressboard for the construction of a solid wall by staggered stacking, the block comprising:

an upper face and a lower face and two opposite ends; a pair of flanges on the upper face and a pair of grooves on the lower face for the assembly of the block by tongue and groove joint, a longitudinal axis of the flanges on the upper face and a longitudinal axis of the grooves on the lower face facing each other two by two on the same vertical axis, a diameter of each groove is greater than a diameter of the flange in the same vertical axis;

the upper face comprising an upper bearing surface located within and delimited by adjacent interior edges of the pair of flanges;

the lower face comprising a lower supported surface located within and delimited by adjacent interior edges of the pair of grooves;

a splined tongue and groove joint at each of the two ends, parallel to the wall facings and perpendicular to the upper and lower faces, for a symmetrical assembly at the two ends of the block; at each splined tongue and groove joint, a group of two countersunk holes perpendicular to the upper face, passing through the block up to the lower face and located on an axis that is parallel to the flanges and between the latter, in the same longitudinal axis as the splined tongue and groove joints;

means for screwing or nailing inserted into each of the countersunk holes at a depth equal to at least one third of the thickness of the block; and wherein the flanges and grooves present a profile in a semicircle.

2. The block according to claim 1 having a rectangular parallelepiped shape with a height up to 20 centimeters.

3. The block according to claim 2 having a length up to 60 centimeters and a ratio of the length to the width not exceeding one third.

4. The block according to claim 2 wherein the flanges and grooves present a profile in a semicircle whose cumulative length of chords or diameters per face does not exceed one third of the width of the block.

5. The block according to claim 4 comprising a bevelled edge profiled on the upper edge of the block and subtracted from the width of the block.

6. The block according to claim 4 wherein the diameter or the chord of the groove is ten percent larger than the diameter of the flange.

7. The block according to claim 4 wherein the distance between the outside edge of the groove and adjacent wall facing is not less than one-tenth of the width calculated on the upper face of the block.

8. The block according to claim 3 comprising more than one splined tongue and groove joint at each of the ends, a scraped area that is caused by the grooves of the splined tongue and groove joints not exceeding one third of the surface area of the square section of the block.

9. The block according to claim 8 wherein the depth of the grooves does not exceed the distance between the wall facing and first line of the grooves.

10. The block according to claim 1 comprising, for each group of two holes and from a leveling course, a distance that is equal to a half-width of the block for one of the holes, and a distance that is equal to three-quarters of the length of the block for the other hole.

11. A block made of solid wood or pressboard for the construction of a solid wall by staggered stacking, the block comprising:

an upper face and a lower face and two opposite ends;

a pair of flanges on the upper face and a pair of grooves on the lower face for the assembly of the block by tongue and groove joint, a longitudinal axis of the flanges on the upper face and a longitudinal axis of the grooves on the lower face facing each other two by two on the same vertical axis, the flanges and grooves each present a profile in a semicircle, a splined tongue and groove joint at each of the two ends, parallel to the wall facings and perpendicular to the upper and lower faces, for a symmetrical assembly at the two ends of the block;

two groups of two holes, one of the groups of two holes located at each splined tongue and groove joint, each of the holes being a countersunk hole perpendicular to the upper face, passing through the block up to the lower face and located on an axis that is parallel to the flanges and between the latter, in the same longitudinal axis as the splined tongue and groove joints;

for each group of two holes, a distance that is equal to a half-width of the block for one of the holes, and a distance that is equal to three-quarters of the length of the block for the other hole, wherein the two groups of two holes are located symmetrically at the two ends of the block.

12. The block according to claim 1 wherein the diameter of the holes does not exceed the side of the width of the groove of the splined tongue and groove joints and allowing passage of screw or metal tips of equal diameter.

13. The block according to claim 1 together with another said block, wherein the splines of the splined tongue and groove joints have dimensions in length, thickness and width that are five percent lower than the grooves of the two blocks placed end to end.

14. The block according to claim 1 together with another said block, wherein said upper face comprises of a region containing said pair of flanges and a remaining end region defined by a portion of the upper face to be covered by joining another block at a right angle at said end region, said end region being free of said pair of flanges.

15. The block according to claim 5 wherein the diameter or the chord of the groove is ten percent larger than the diameter of the flange.

16. The block according to claim 5 wherein the distance between the outside edge of the groove and adjacent wall facing is not less than one-tenth of the width calculated on the upper face of the block.

17. The block according to claim 1 together with another said block, wherein said upper face comprises of a region containing said pair of flanges and a remaining end region defined by a portion of the upper face to be covered by joining another block at a right angle at said end region.

* * * * *